US005452692A

United States Patent [19]

Spray et al.

[11] Patent Number: 5,452,692

[45] Date of Patent: Sep. 26, 1995

[54] INTERNAL COMBUSTING ENGINE

[75] Inventors: Richard H. Spray, Studley; Roger D. Stone, Brighton, both of England

[73] Assignees: Rover Group Limited, England; Kia Motors Corporation, Rep. of Korea

[21] Appl. No.: 293,830

[22] Filed: Aug. 22, 1994

[30] Foreign Application Priority Data

Aug. 27, 1993 [GB] United Kingdom ..... 9317912

[51] Int. Cl.[6] ..... F02F 7/00

[52] U.S. Cl. ..... 123/195 C; 123/195 R

[58] Field of Search ..... 123/195 R, 195 C, 123/196 R

[56] References Cited

U.S. PATENT DOCUMENTS

| | | | |
|---|---|---|---|
| 3,540,425 | 11/1970 | Scheiterlein et al. | 123/195 R |
| 3,973,548 | 8/1976 | Celli | 123/195 R |
| 4,393,822 | 7/1983 | Obermayer et al. | 123/195 R |
| 4,480,368 | 11/1984 | Vachon | 123/195 R |
| 4,773,366 | 9/1988 | Seidl et al. | 123/196 R |

FOREIGN PATENT DOCUMENTS

| | | | |
|---|---|---|---|
| 0077033 | 4/1983 | European Pat. Off. . | |
| 0240120 | 10/1987 | European Pat. Off. . | |
| 4137534 | 5/1992 | Germany . | |
| 4204522 | 4/1993 | Germany . | |
| 47981 | 6/1930 | Norway | 123/195 R |
| 1541421 | 2/1979 | United Kingdom . | |
| 2167492 | 5/1986 | United Kingdom . | |
| 2234011 | 1/1991 | United Kingdom . | |

*Primary Examiner*—Noah P. Kamen
*Attorney, Agent, or Firm*—Davis, Bujold & Streck

[57] ABSTRACT

An internal combustion engine comprises a cylinder block, an upper crankcase, and a lower crankcase, which comprises an inner casing including an outer wall and the lower main bearing housings, and an outer casing, with a space therebetween. The outer casing has a sump mounted on it. Oil drainage passages from the cylinder head face of the cylinder block extend down to meet a pair of longitudinal passages from which oil drainage ports open into the space between the inner and outer casings. These passages add significantly to the stiffness of the engine.

14 Claims, 4 Drawing Sheets

INTERNAL COMBUSTING ENGINE

The present invention relates to internal combustion engines and to the problem of noise reduction in such engines.

BACKGROUND OF THE INVENTION

It is known, for example from GB 2 234 011 to provide an internal combustion engine comprising a cylinder block, an upper crankcase, a lower crankcase, a crankshaft and a sump attached to a skirt on the cylinder block and defining a sump region, wherein the lower crankcase comprises an inner casing attached to the upper crankcase such that the upper crankcase and the inner casing support the crankshaft.

This design suffers from the disadvantages that noise is transmitted from the inner casing to the sump and transferred from the upper crankcase to the sump.

SUMMARY OF THE INVENTION

Accordingly the present invention provides an internal combustion engine comprising a cylinder block, an upper crankcase, a lower crankcase, a crankshaft and a sump defining a sump region, wherein the lower crankcase comprises an inner casing attached to the upper crankcase and the upper crankcase and the inner casing support the crankshaft, the lower crankcase further comprises an outer casing attached to the upper crankcase and having at least a portion thereof spaced from the inner casing thereby to reduce the transmission of noise from the inner casing to the outer casing, and both casings extend beneath the crankshaft thereby to separate it from the sump region. This arrangement can help to reduce the noise transmitted from the inner crankcase to the sump.

Preferably the inner casing comprises a plurality of bearing support portions joined by casing portions.

More preferably the inner casing is formed as a single casting.

Preferably the outer casing comprises a mounting member attached to the upper crankcase by fasteners. This can help to isolate the sump from vibration in the upper crankcase, particularly if the sump is attached to the outer casing.

Preferably the upper crankcase has oil drainage passages arranged to drain oil into the space between the inner and outer casings. This oil helps to dampen noise and is kept away from the crankshaft by the inner casing which reduces drag.

Desirably the inner casing has openings therein to allow oil to drain from inside the inner casing to the space between the inner and outer casings.

Preferably, in the region of at least one web of the crankshaft, the upper crankcase and the inner casing define a space which is substantially circular in cross section in which the web rotates. Desirably the diameter of said cross section is only slightly larger than the diameter of the circle swept out by the web as it rotates This helps to reduce the amount of air circulating with the crankshaft and therefore helps to reduce drag.

The inner casing may meets the upper crankcase approximately level with the axis of the crankshaft.

Preferably the outer casing has two side walls attached to the upper crankcase and a base joining the side walls and extending between the inner casing and the sump region.

Preferably the outer casing further comprises a depending skirt to which the sump is attached.

The outer casing may meet the upper crankcase approximately level with the axis of the crankshaft.

Preferably the upper crankcase has two longitudinal passageways formed therein, one on either side of the axis of the engine, which extend substantially the whole length of the crankcase and serve to stiffen the upper crankcase.

The present invention further provides an internal combustion engine comprising a cylinder block, an upper crankcase, and a lower crankcase, wherein the upper crankcase has two longitudinal passageways formed therein, one on either side of the axis of the engine, which extend substantially the whole length of the crankcase and serve to stiffen the upper crankcase.

Preferably the passageways are enclosed within the upper crankcase.

Preferably the passageways are spaced from the lower face of the upper crankcase.

Desirably the passageways each have a lower wall formed in the upper crankcase and separating them from the lower face of the upper crankcase.

Preferably drainage passages defined in the upper crankcase extend from the passageways to the lower face of the upper crankcase.

BRIEF DESCRIPTION OF THE DRAWINGS

Preferred embodiments of the present invention will now be described by way of example only with reference to the is accompanying drawings in which.

DESCRIPTION OF THE PREFERRED EMBODIMENTS

Figure 1:
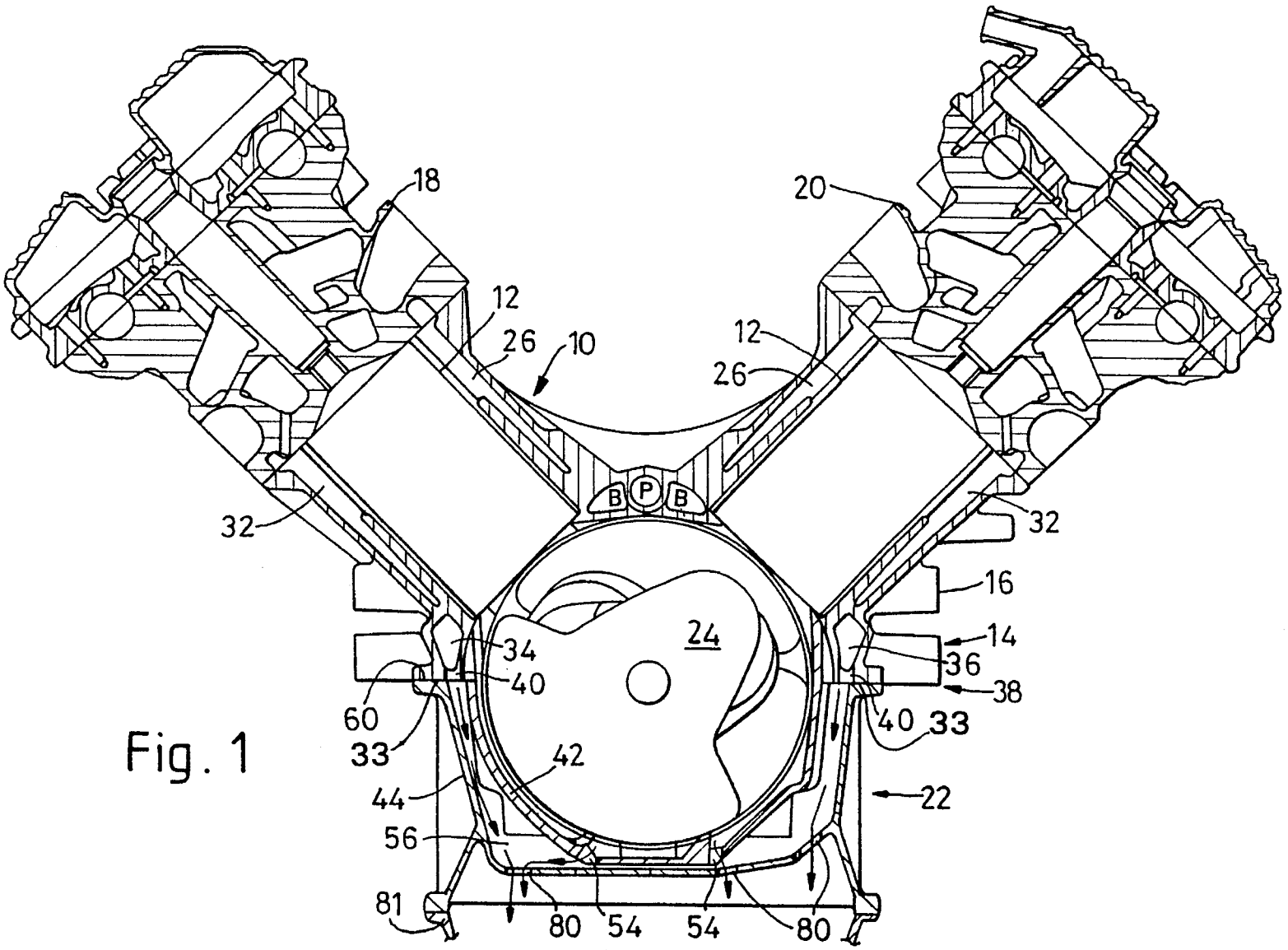
FIG. 1 is a cross section through an engine according to the invention.

Referring to FIG. 1 an engine according to an embodiment of the invention is in a V6 configuration and comprises a cylinder block 10 having two rows of three cylinders 12, an upper (first) crankcase 14 formed with the cylinder block 10 as a single casting 16, two cylinder heads 18,20, a lower (second) crankcase 22, and a crankshaft 24.

Figure 2:
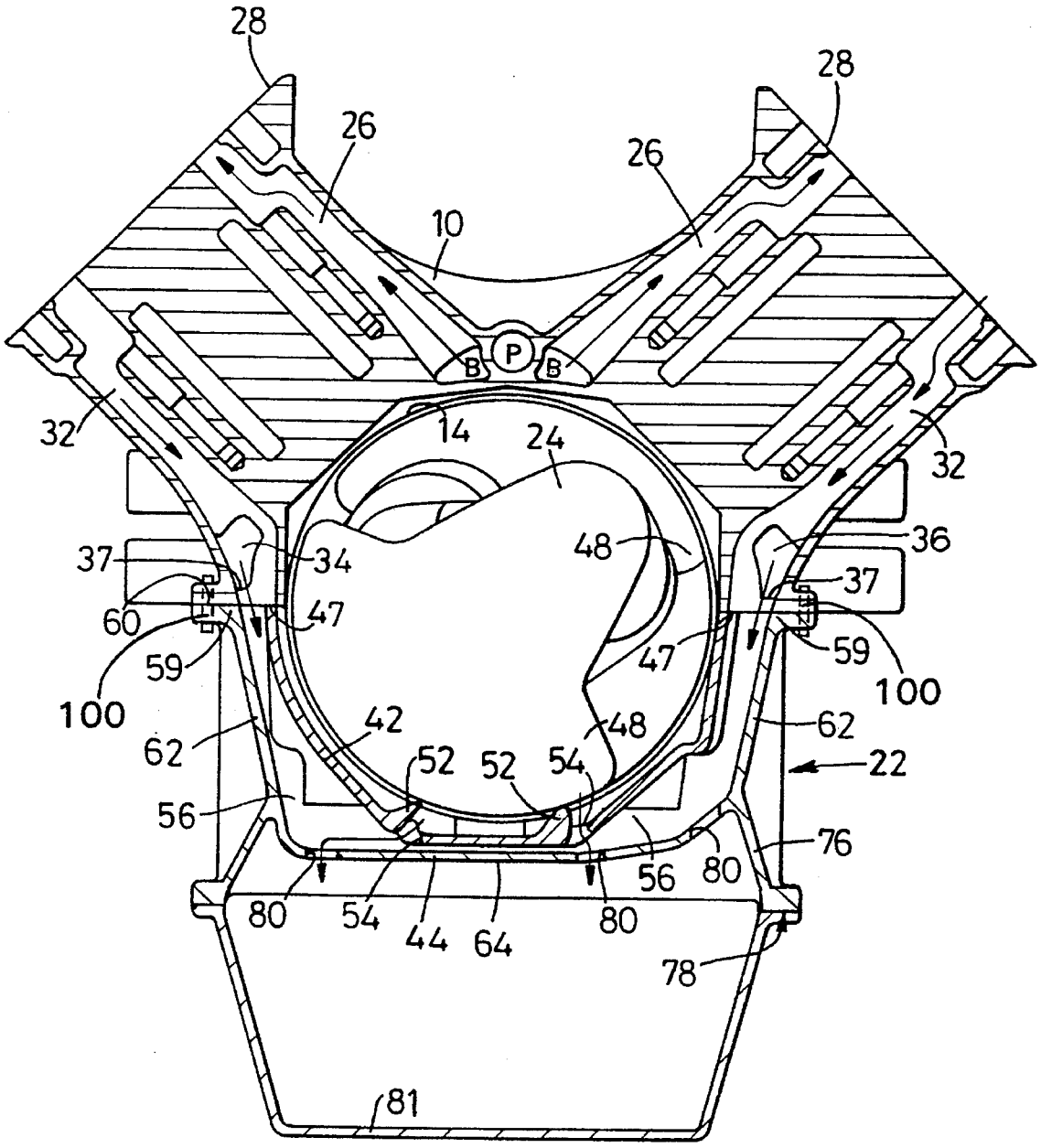
FIG. 2 is a cross section through the engine of FIG. 1 at a different point, and on a larger scale.
Figure 4:
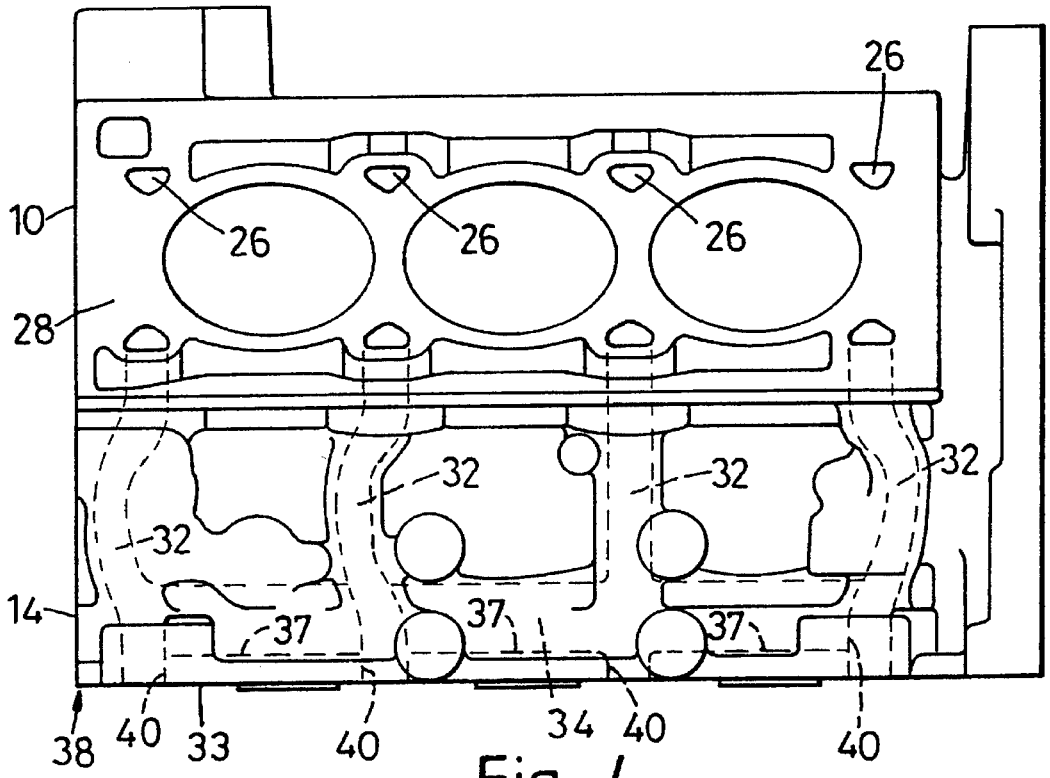
FIGS. 4 and 5 are side views from opposite sides of the cylinder block and upper crankcase of the engine of FIG. 1.
Figure 5:
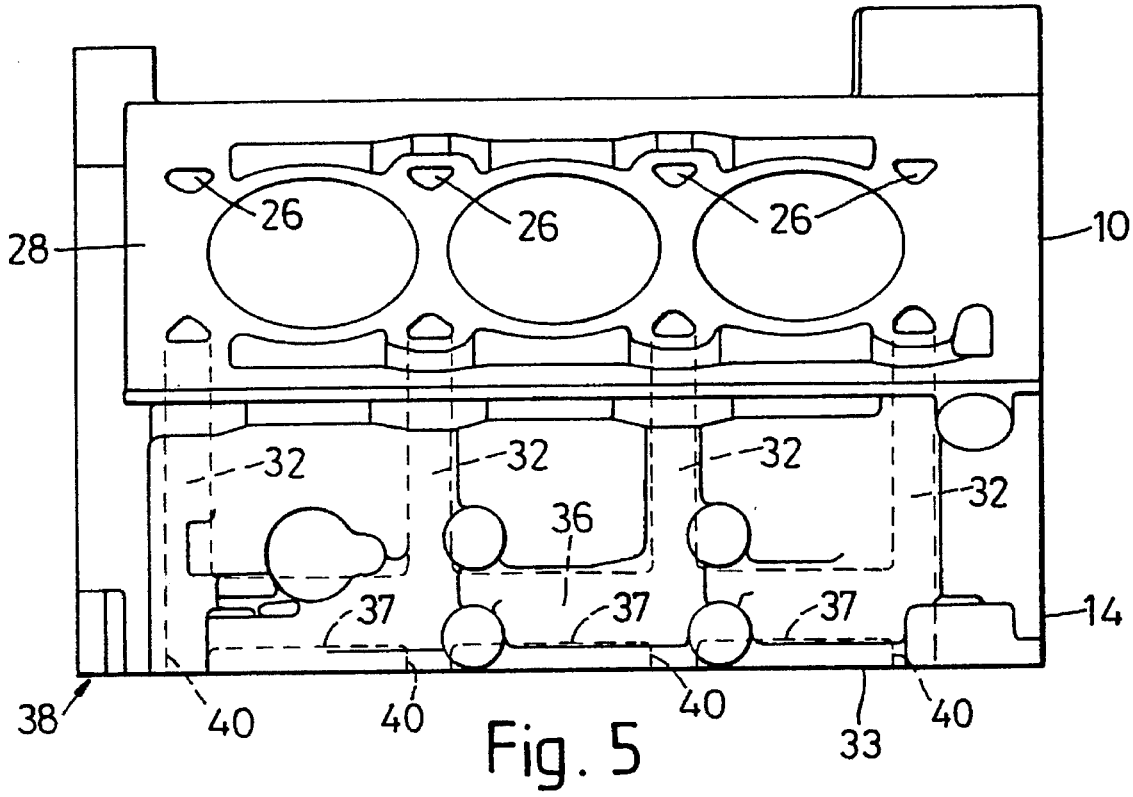

As can be seen from FIGS. 2, 4 and 5, oil drainage passages 32 extend through the cylinder block 10 from the cylinder head faces 28, downwards to the lower faces 33 of the upper crankcase 14. At their upper ends the drainage passages 32 surround the outer cylinder head bolts (not-shown) which hold the cylinder heads 18,20 to the cylinder block 10. They then deviate away from the lower ends of the cylinder head bolts before reaching the lower faces 33 of the upper crankcase 14. A pair of longitudinal passages 34,36 run along the upper crankcase 14 parallel to the crankshaft 24 near the crankshaft split line 38, one on either side of the crankshaft 24. As can best be seen in FIG. 1, the passages 34, 36 are defined entirely by the upper crankcase and are enclosed within it. They have a lower wall 37 which separates them from the lower crankcase 22. They each connect together the drainage passages 32 on one side of the crankcase just above the crankcase split line 38. Because they extend along substantially the full length of the upper crankcase 14 they add considerably to its stiffness. The lower ends of the drainage passages 32 form drainage ports 40 which lead from the longitudinal passages 34,36 down to the crankshaft split line 38.

Breathing passages 26 also extend through the cylinder block 10 from the cylinder head faces 28, where they surround the inner cylinder head bolts (not shown), down into the region of the crankcase 14 above the crankshaft 24. The lower ends of these breathing passages are baffled to prevent oil being thrown back up into them.

Figure 3:
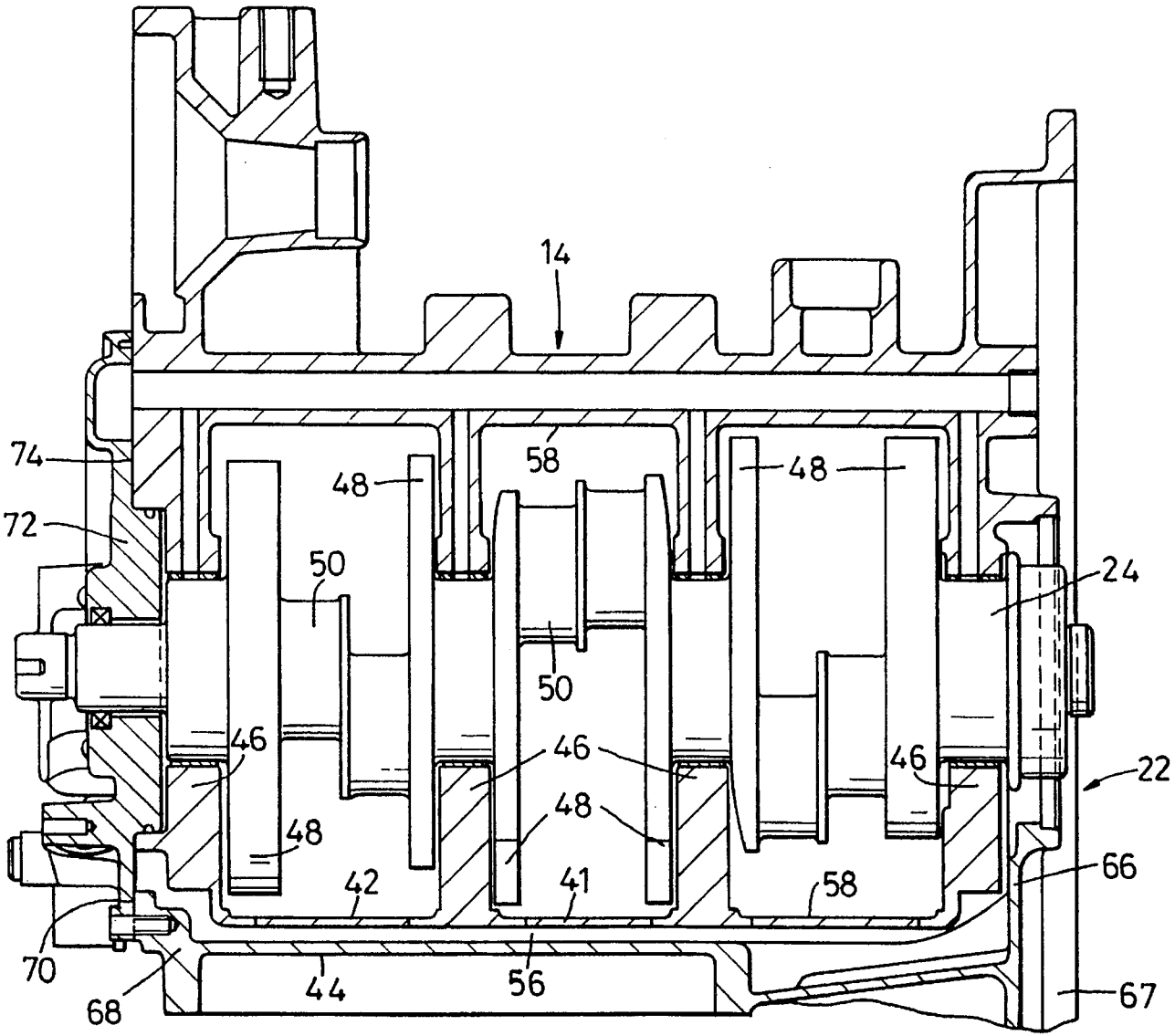
FIG. 3 is a longitudinal section through the engine of FIG. 1.

As can best be seen in FIGS. 2 and 3, the lower crankcase 22 comprises an inner casing 42 and an outer casing 44. The inner casing 42 is a single casting comprising the lower four main bearing housings 46 forming the bearing ladder with casing portions 58 joining them together and forming an outer wall 41. The inner casing 42 secured at its upper edge 47 to the upper crankcase by bolts (not shown), two on either side of each main bearing housing 46. The crankshaft 24 is of conventional design having webs 48 to balance the crankpins 50. The outer wall 41 of the inner casing 42 has a pair of inward projections 52 arranged to be just clear of the outer edge of each of the webs 48 as they rotate. These projections skim oil off the webs as they rotate thereby reducing the amount of oil which is flung off the webs. A set of openings 54 in the inner casing 42 are provided next to the projections 52 to allow oil to drain out into the space 56 between the inner and outer casings. One side of each projection 52 forms a single surface 53 with one side of a respective one of the openings 54 so that oil skimmed off by the projections runs directly down through the openings.

The cross section of the interior of the crankcase in the regions 58 between the main bearings 46 is substantially circular and is only slightly larger in radius than the crankshaft webs 48. This results in very low air drag acting on the crankshaft as it rotates.

The outer casing 44 is a single casting surrounding the inner casing and is attached at its upper edge 59 (mounting member) to the upper crankcase 14 by a series of bolts (fasteners) 100 along its upper face 60. It has two side walls 62 and a base 64 which are spaced from the inner casing 42. At one end it has an end wall 66 which is also spaced from the inner casing 42 and forms part of the flywheel housing 67. The inner casing 42 is therefore separated from the flywheel housing 67 by the end wall 66 of the outer casing 44. At the other end 68 it forms a lower mounting face 70 for the oil pump 72 which is also attached to a main mounting face 74 formed by the upper crankcase 16 and the inner casing 42. Depending from the side walls 62 is an outer skirt 76 with an oil sump mounting face 78 on its lower edge. A series of openings 80 in the outer casing allow oil to drain out into the sump 81.

The upper edges 47,59 of the inner and outer casings 42,44 are spaced apart where they meet the upper crankcase 16 at the crankcase split line 38, which is approximately level with the axis of the crankshaft.

The oil drainage ports 40 from the longitudinal passages 34,36 in the upper crankcase 14 open into the space 56 between the inner and outer casings 42,44. Oil from the longitudinal passages 34,36 therefore flows down in the space between the inner and outer casings 42,44.

As the crankshaft is held between the upper crankcase 14 and the inner casing 42, the vibrations it causes are largely isolated from the outer casing 44 of the lower crankcase. Thus the amount of vibration transmitted to the outer walls of the lower crankcase is reduced, thereby reducing the amount of noise produced there. Also because the inner casing 42 and the base 64 of the outer casing 44 both extend beneath the crankshaft 24 they form a double barrier between the crankshaft and the sump 81 which reduces the amount of noise radiated into the sump, thereby reducing the amount of vibration of sump and noise produced there. This reduction in noise is also helped by the oil between the inner and outer casings of the lower crankcase which tends to damp out noise transmitted between them.

Although this invention has been described with particular reference to a V6 engine, it will be appreciated that it can also be used in other engine designs, such as in line engines.

We claim:

1. An internal combustion engine comprising:

a cylinder block;

a first crankcase being connected to said cylinder block;

a second crankcase having an inner casing and an outer casing and both said casings being attached to said first crankcase, and said outer casing having at least a portion thereof spaced from said inner casing thereby to reduce noise transmission from said inner casing to said outer casing;

a crankshaft being supported between said first crankcase and said inner casing; and, a sump defining a sump region, said sump being attached to said second crankcase and said sump region being separated from said crankshaft by said inner and said outer casings.

2. An engine according to claim 1 wherein the inner casing comprises a plurality of bearing support portions and casing portions which join the bearing support portions together.

3. An engine according to claim 2 wherein the inner casing is formed as a single casting.

4. An engine according to claim 1 wherein the outer casing comprises a discrete member for attachment to the first crankcase by at least one fastener.

5. An engine according to claim 1 wherein the sump is attached to the outer casing.

6. An engine according to claim 1 wherein the inner and outer casings define a space therebetween and the first crankcase has oil drainage passages arranged to drain oil into the space.

7. An engine according to claim 6 wherein the inner casing has openings therein to allow oil to drain from inside the inner casing to the space between the inner and outer casings.

8. An engine according to claim 1 wherein the crankshaft has at least one web, the upper crankcase and the inner casing define a space which is substantially circular in cross section in which the web rotates.

9. An engine according to claim 8 wherein the web sweeps out a circle as the web rotates and the diameter of said cross section is only slightly larger than the diameter of said circle.

10. An engine according to claim 1 wherein the crankshaft has an axis of rotation and the inner casing meets the first crankcase approximately level with said axis.

11. An engine according to claim 1 wherein the outer casing has two side walls attached to the first crankcase and a base joining the side walls and extending between the inner casing and the sump region.

12. An engine according claim 11 wherein the outer casing further comprises a depending skirt to which the sump is attached.

13. An engine according to claim 1 wherein the outer casing meets the first crankcase approximately level with the axis of the crankshaft.

14. An engine according to claim 1 wherein the first crankcase has two longitudinal passageways formed therein, one on either side of the engine, which extend substantially the whole length of the crankcase and serve to stiffen the first crankcase.

* * * * *

UNITED STATES PATENT AND TRADEMARK OFFICE

CERTIFICATE OF CORRECTION

PATENT NO. : 5,452,692

DATED : September 26, 1995

INVENTOR(S) : Richard Huish SPRAY & Roger Derrick STONE

It is certified that error appears in the above-identified patent and that said Letters Patent is hereby corrected as shown below:

On the title page, item [54], & column 1, change "INTERNAL COMBUSTING ENGINE" to --INTERNAL COMBUSTION ENGINE--

Signed and Sealed this

Sixth Day of February, 1996

Bruce Lehman

*Attest:*

BRUCE LEHMAN

*Attesting Officer*

*Commissioner of Patents and Trademarks*